United States Patent [19]

Murphy et al.

[11] Patent Number: 4,722,444

[45] Date of Patent: Feb. 2, 1988

[54] METHOD AND APPARATUS FOR DOCUMENT PROCESSORS

[75] Inventors: Gary J. Murphy, Frederick, Md.; Roy E. Dempster, Jr., Richardson, Tex.; Michael R. Barnes; Michael J. Murphy, both of Frederick, Md.

[73] Assignee: BancTec Inc., Dallas, Tex.

[21] Appl. No.: 720,886

[22] Filed: Apr. 8, 1985

[51] Int. Cl.[4] ..... B07C 3/02

[52] U.S. Cl. ..... 209/583; 209/548; 235/437; 382/7; 382/57

[58] Field of Search ..... 209/569, 583, 584, 900, 209/942, 548; 235/437, 475–477, 481; 382/7, 57; 198/447

[56] References Cited

U.S. PATENT DOCUMENTS

| | | | |
|---|---|---|---|
| 405,088 | 6/1889 | Ferguson | 198/447 |
| 3,028,961 | 4/1982 | Pouliart et al. | 209/569 |
| 3,895,220 | 7/1975 | Nelson et al. | 209/900 |
| 4,068,212 | 1/1978 | Templeton | 382/57 |
| 4,222,813 | 9/1980 | Jodrey | 198/447 |
| 4,456,127 | 6/1984 | Hams | 209/584 |
| 4,564,752 | 1/1986 | Lepic et al. | 382/57 |
| 4,606,660 | 8/1986 | Bradshaw et al. | 209/584 |

*Primary Examiner*—Robert B. Reeves
*Assistant Examiner*—Donald T. Hajec
*Attorney, Agent, or Firm*—Kenneth R. Glaser

[57] ABSTRACT

Document processor equipment for processing documents requiring operator intervention for the purpose of functions like key entry and encoding of data associated with certain ones of the documents includes an improved system for transporting and presenting documents to the operator for such intervention. A document view station has split parallel transport paths for routing documents requiring operator intervention to the front path near the operator with documents not requiring operator intervention being routed to and along a rear path, the respective routing being effected by a diverter automatically controlled in response to information read from the documents. A preview station and document hold station are respectively provided upstream and downstream from the document view station.

3 Claims, 7 Drawing Figures

Mr. & Mrs. John Q. Public
100 ANYWHERE AVENUE
DALLAS, TEXAS 75000

3625

12-15 19 80 No.

PAY TO THE ORDER OF BANK CARD SERVICE $ 10.00 3

Ten dollars and no/cents DOLLARS

BANCTEC NATIONAL BANK
DALLAS, TEXAS

John Q. Public

⑆111905696⑆625⑈011⑈073⑈6⑈ ⑈000000 1000⑈ 4

1

FIG. 6

BANCTEC NATIONAL BANK
DALLAS, TEXAS

REMITTANCE
ADVICE

ACCOUNT NUMBER
1856307465

MAKE CHECK PAYABLE TO ▶

BANK CARD SERVICE
BANCTEC NATIONAL BANK
4435 SPRING VALLEY ROAD
DALLAS, TX 75234

| NEW BALANCE | MINIMUM PAYMENT | PAYMENT DUE DATE |
|---|---|---|
| | | 12-25-80 |

$ 10 00
AMOUNT OF YOUR CHECK

MR. OR MRS. JOHN Q. PUBLIC
100 ANYWHERE AVENUE
DALLAS, TEXAS 75000

⑈122580000722000722185630746514 6⑈

2 5

FIG. 7

METHOD AND APPARATUS FOR DOCUMENT PROCESSORS

The present invention relates generally to document processing, more particularly to document processors of the type involving operator intervention, even more particularly to an improved method and apparatus for the presentation and transport of documents requiring operator intervention, and even more particularly to remittance processors.

It is well known that the proliferation of commercial documents have required the development of document processor equipment to automatically handle, sort and process documents and the information represented thereon. Such equipment normally includes an operator viewing station where the operator, upon presentation of the documents or their images, selectively intervenes with respect to certain ones of these documents for the purpose of key entry of data, document rejection, or the performance of other operations associated with these selected documents.

For example, one class of document processor equipment are computerized remittance processors for automatically processing payment and payment record documents and their data. In accordance with well known, high volume remittance processing operations, individuals in making payment of their credit card balances, bank notes, utility bills, etc. forward both a remittance document (check) and a remittance advice document (transaction summary) to a central location where these documents and/or the captured information on the face of the documents are automatically processed for appropriate account reconcilation and credit. During such processing, the checks and remittance advice documents are transported by the remittance processor past an operator viewing station where the operator selectively intervenes with respect to certain ones of these documents to key enter data with respect to checks which are to be subsequently encoded and/or with respect to remittance advice documents which may be defectively encoded or which contain non-machine readable data.

With respect to existing document, and particularly remittance, processors, each and every document, whether requiring operator intervention or not, is sequentially advanced through the operator viewing station for presentation to the operator, many times being halted at such station for operator review. Consequently, the operator must await each document not requiring operator intervention to advance out of the way of operator view, thus greatly slowing down the overall document processing operation.

It is therefore the principal object of the present invention to provide a new and improved method and apparatus for document processing, particularly for use with automatic document processors which simultaneously process both documents of the type requiring, and those not requiring, operator intervention.

Another object of the present invention is to provide a new and improved method and apparatus for the transport and presentation of only those documents at an operator view station which require operator intervention, thereby substantially increasing the speed of document processing, as well as enhancing operator viewing of such documents.

It is a still further object of the present invention to provide a new and improved remittance processor.

Specific features of the invention, as well as additional objects and advantages thereof, will become more readily understood by reference to the following detailed description taken in conjunction with accompanying drawings, in which.

Figure 1:
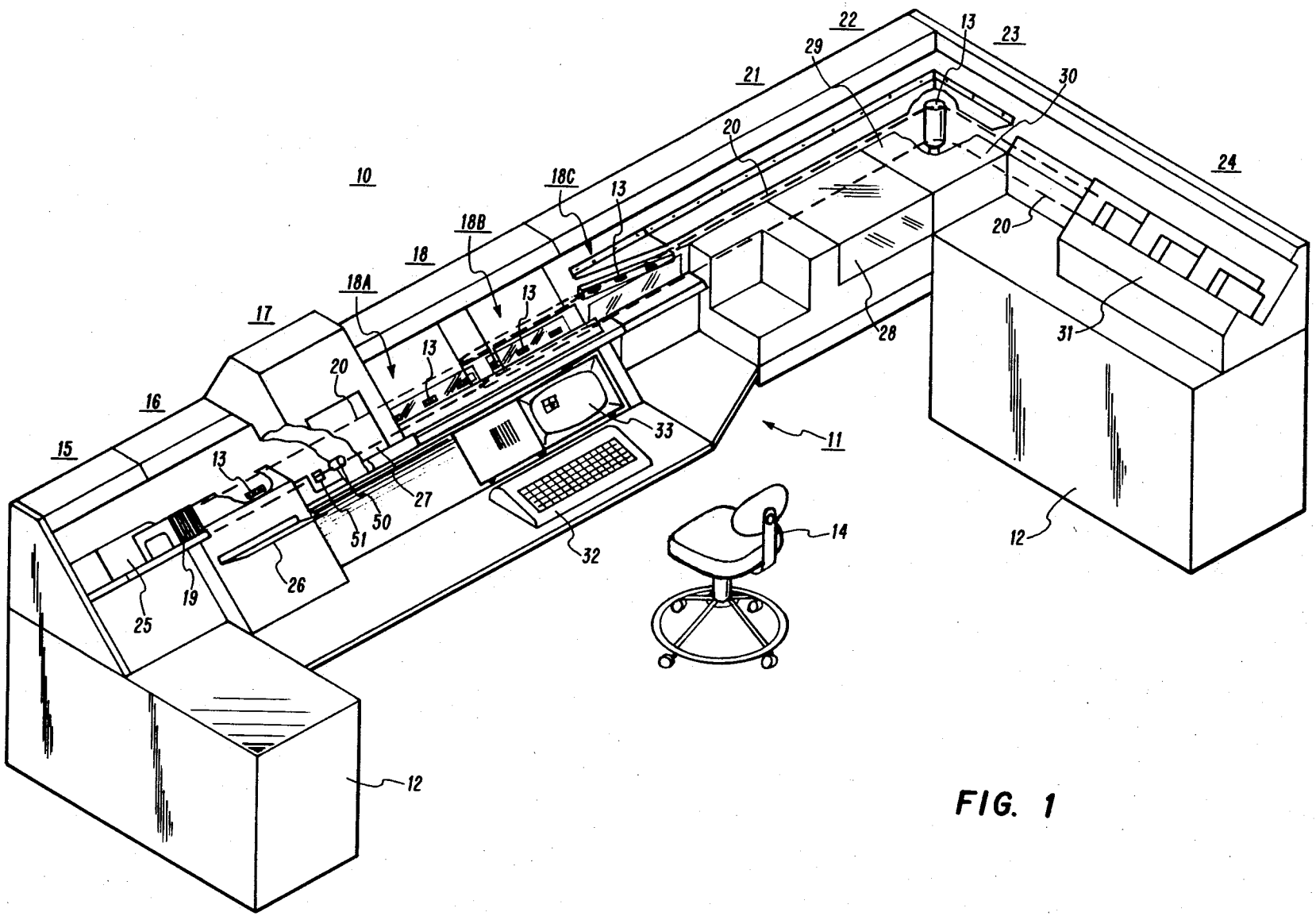
FIG. 1 is an overall front perspective view of a document processor, having a preferred use as remittance processor, and incorporating the features of the present invention.

The drawings are not necessarily to scale and in some instances, portions have been exaggerated in order to emphasize the various features of the invention.

The method and apparatus of the present invention have general application for document processors, particularly for document processors simultaneously and sequentially processing documents that require operator intervention and those that do not require operator intervention. As used throughout the specification and claims, the term "operator intervention" means and refers to any function or operation performed by the document processor operator on or in connection with a particular document, such as, for example, key entry of data corresponding to information on a document, key entry of data corresponding to defective information on a document, or rejection of a particular document.

While various types of document processors and document processing applications can utilize the present invention, the method and apparatus of the invention are now initially described with respect to a remittance processing operation for processing remittance and remittance advice documents. As used throughout the following description and claims, the term "remittance document" means and refers to a check, money order, or other similar type of transfer of funds instrument, one example of which is the check depicted by the reference numeral 1 in FIG. 6. The term "remittance advice document" means and refers to an encoded payment transaction form indicating, among other things, the payment amount due, one example of which is the stub depicted by the reference numeral 2 in FIG. 7. Both the remittance documents and the remittance advice documents are then processed in a remittance processor in accordance with the method, and incorporating the apparatus, of the invention, the specific details of which are now described.

Referring now to FIG. 1, a preferred embodiment of a document processor 10 having a use, for example, as a remittance processor and incorporating the features of the present invention is embodied within a desk type work station housing 11. The housing 11 is configured to define pedestal bases 12 supporting an overall transport assembly which sequentially transports remittance and remittance advice documents past the hereinafter described respective work stations. The overall transport assembly (the rotating document advance rollers of which are depicted at various locations in FIG. 1 by the reference numerals 13) has an essentially L-shaped configuration so that an operator positioned in front of the housing (within chair 14) has convenient access to each of the respective work stations.

Proceeding in the order or sequence of document travel, the work stations of the remittance processor comprise, in a preferred form, an automatic feed station 15; a manual feed station 16; a document reading station 17; a document presentation station 18, including preview station 18A, primary viewing station 18B, and document hold station 18C; an encoding station 21; an endorsing station 22; an audit trail print station 23; and an output stacking station 24.

Disposed at the automatic feed station 15 is an automatic document feeder 25 of conventional construction effective to automatically feed into the transport assembly a set 19 of the remittance and remittance advice documents which have been prearranged in accordance with the desired feed sequence. Alternatively, each of the documents may be manually inserted into the transport assembly at the manual feed station 16 from a stacking tray 26 being provided at such station.

Disposed at the document reading station 17 is a document reader assembly 27 having one or more optical character recognition (OCR) read heads 50, and a magnetic ink character recognition (MICR) read head 51, the OCR and MICR readers 50 and 51 being any one of a number of conventional and commercially available devices presently on the market. The document reader assembly 27 is therefore effective to detect and read selective encoded machine readable data or information on the face of the remittance and remittance advice documents and, in response thereto, to generate appropriate signals in the manner and for the purpose subsequently described.

The remittance processor 10 also includes a document encoder 28 (at encoding station 21) for imprinting machine-readable, usually MICR, data on the face of the documents transported to station 21; an endorser 29 for endorsing appropriate information on the front or back of the remittance document at the station 22; an audit trail printer 30 (at the audit trail print station 23); and a pocket type sorter 31 (at the output stacking station 24) for receiving and appropriately sorting the processed documents. The encoder 28, endorser 29, printer 30, and sorter 31 are all of conventional design and operation, are well known and common assemblies of remittance processors, and do not in and of themselves form a part of the present invention.

The documents are sequentially transported by the transport assembly along a main elongated document transport passageway (depicted by dashed lines in FIG. 1 and by reference numerals 20) from the feed stations through and past the respective work stations to the output stacking station 24. The transport assembly itself may be any type of high speed transport, including for example a plurality of endless belt driven friction wheels or rollers (such as those depicted by reference numeral 13), the operation and sequencing of the transport assembly (as well as the operating assemblies at the various stations) being controlled by an independently programmable computer processor unit (not shown).

In accordance with the overall remittance processing operation carried out by the equipment 10, each transaction set of remittance and remittance advice documents are initially precollated and then respectively inputted by the operator to the transport assembly, either automatically at the feed station 15 or manually at the feed station 16. By "transaction set" is meant the set of checks 1 and stubs 2 which make up a particular payment transaction. For example, in most situations, the payer will enclose a single check along with one month's payment stub in the payment envelope, in which event the transaction set will comprise a single remittance document and a single remittance advice document. There may be instances, however, where a transaction set may comprise a single stub with multiple checks or, alternatively, multiply stubs with a single check.

Each of the documents are then automatically transported past the document reader 27 to, and halted at, the document presentation station 18 for the purpose of operator review of those documents that require key entry of data corresponding to that document. For example, and with reference to FIG. 6, checks 1 that have been advanced to the presentation station do not, at that time, have the dollar amount 3 machine-encoded on the face of the check; and such data must therefore be subsequently encoded (within the field 4) by the document encoder 28. Consequently, the operator (using keyboard 32) will key enter the dollar amount data to be encoded by encoder 28. Furthermore, and with reference to FIG. 7, the OCR encoded data within the field 5 on some of the stubs 2 may be defective (non-machine readable); and under these circumstances, such data must be key inputted by the operator so that the information on the remittance stubs may be subsequently automatically processed. Consequently, with respect to these documents requiring operator intervention, the operator, with the use of the terminal keyboard 32 and CRT display means 33, keyboard inputs the required information (dollar amount for check and defective data for stubs) and then advances these documents for subsequent processing. The documents, in the conventional and well known manner, are all respectively sequentially advanced to the subsequent work stations and eventually sorted at the output station 24.

For the purpose of increased speed of document processing, and to avoid presenting documents for operator review not requiring operator intervention, the document presentation station 18, in accordance with the invention, comprises three laterally adjacent sub-stations, namely a preview station 18A, a primary viewing station 18B, and a document hold station 18C; and in accordance with the operation, and for the purpose, subsequently described, documents being transported through the remittance processor apparatus are temporarily halted at each of these sub-stations.

Figure 2:
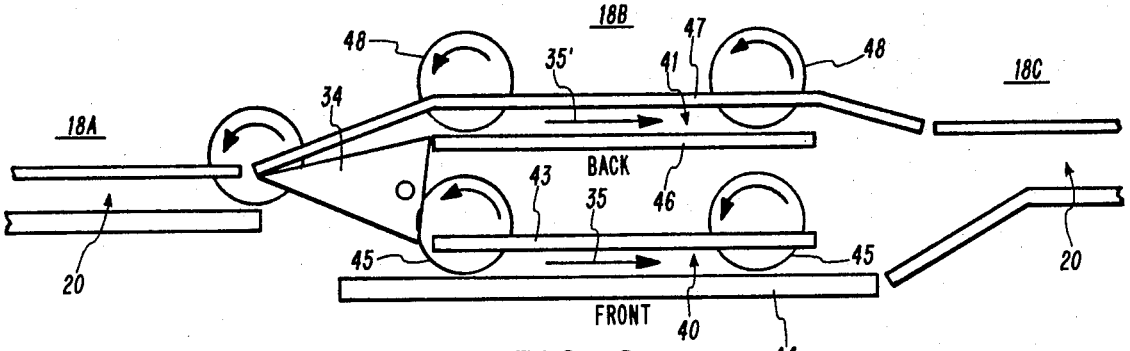
FIGS. 2 and 3 represent simplified illustrations, partially schematic, of the document presentation station of the equipment illustrated in FIG. 1, from the top thereof, particularly emphasizing the split path arrangement of the primary operator viewing station.
Figure 3:
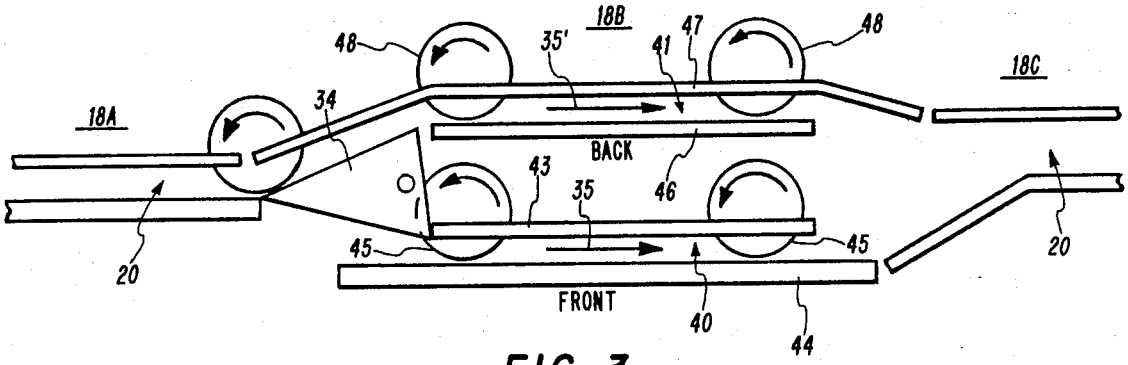

The substation 18B constitutes the primary viewing station at which those documents with respect to which key entry of data is needed are halted and presented for operator review. In accordance with the principal feature of the present invention, and as best depicted in FIGS. 2 and 3, the primary viewing station 18B is so configured to define a pair of parallel document transport paths 40 and 41 with a diverter 34 being actuated to selectively direct documents entering the primary viewing station (from the portion of the main document transport passageway 20 at the substation 18A) to either the front path 40 or the rear path 41. It is to be understood that the designations "front" and "rear" refer to the respective orientations with respect to the operator positioned in front of the housing 11, the "front" path 40 thereby designating the path nearest the operator.

In accordance with the preferred embodiment depicted in the drawings, the front transport path 40 is formed between a rectangular shaped vertically extending projection 44 and a guide plate 43, with rotatably driven friction wheels 45 extending through the guide plate 43 and adapted to rotate (in the direction of the arrows shown in FIGS. 2 and 3) to advance documents in the front transport path 40 in the direction of arrow 35. In similar manner, the rear transport path 41 is defined between a vertically extending rectangular projection 46 and a back wall 47, with rotatably driven friction wheels 48 extending through wall 47 and adapted to rotate (in the direction of the arrows) to advance documents in the rear path 41 in the direction of the arrow 35'. Preferably, projections 44 and 46 are of transparent material to facilitate the viewing of documents within the respective transport paths.

Figure 5:
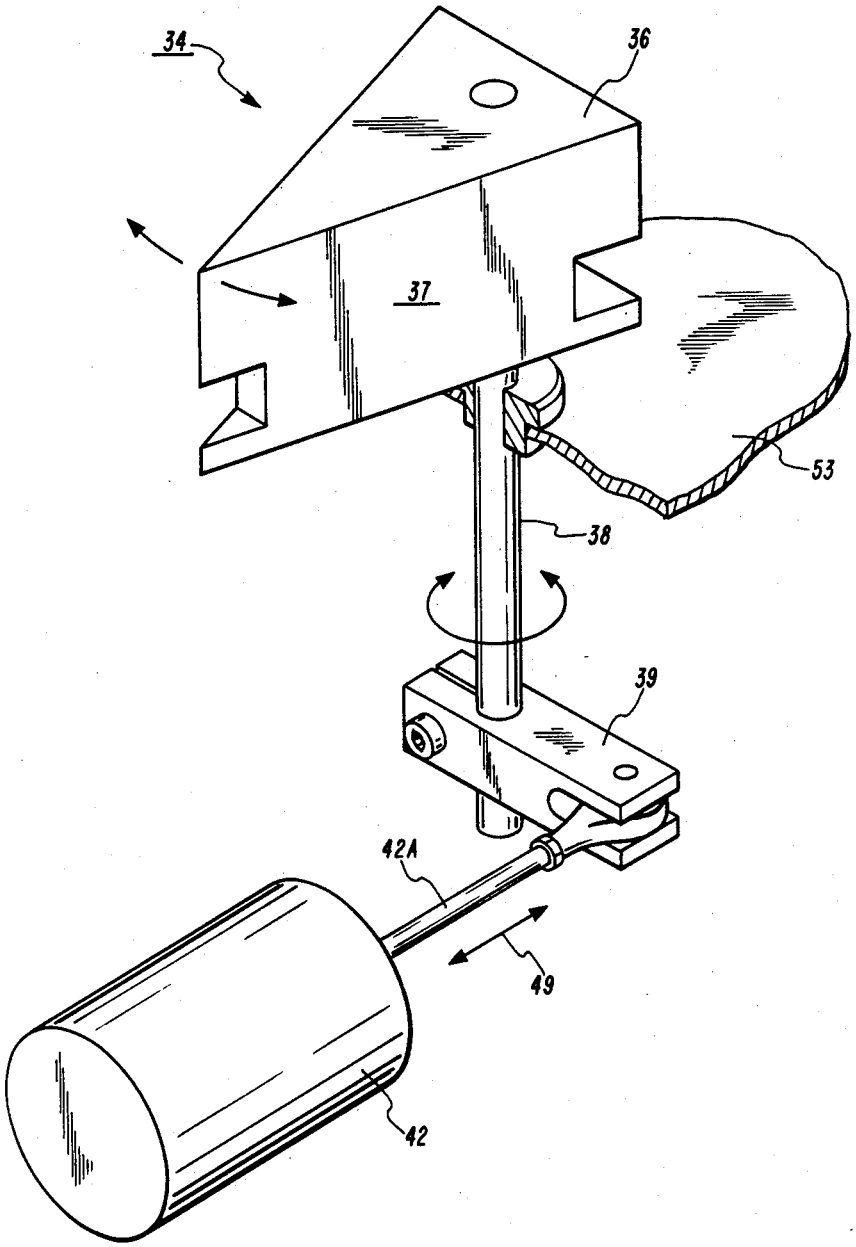
FIG. 5 illustrates the details of the diverter mechanism shown in schematic form in FIGS. 2 and 3; and, FIGS. 6 and 7 respectively illustrate two types of documents that can be processed by the equipment shown in FIG. 1.

As best depicted in FIG. 5, the diverter 34, in a preferred embodiment, comprises a wedge-shaped body 36 with document engaging faces 37 (FIGS. 2, 3 and 5). The diverter head 36 is coupled to a solenoid actuator 42 by way of a shaft 38 (extending through the housing floor 53) and a clevis type coupler 39 so that actuation of the solenoid to translate the solenoid linkage **42*a* in either of the opposed directions indicated by arrow 49 will correspondingly pivot the diverter head in either the clockwise or counterclockwise direction. As depicted in FIG. 2, when the solenoid is actuated to pivot the diverter 34 in the clockwise direction, documents entering the primary viewing station 18B will be directed into the front transport path 40; and as depicted in FIG. 3, when the solenoid actuates the diverter in the counterclockwise direction, documents entering the viewing station 18B will be directed into the rear transport path 41**.

Figure 4:
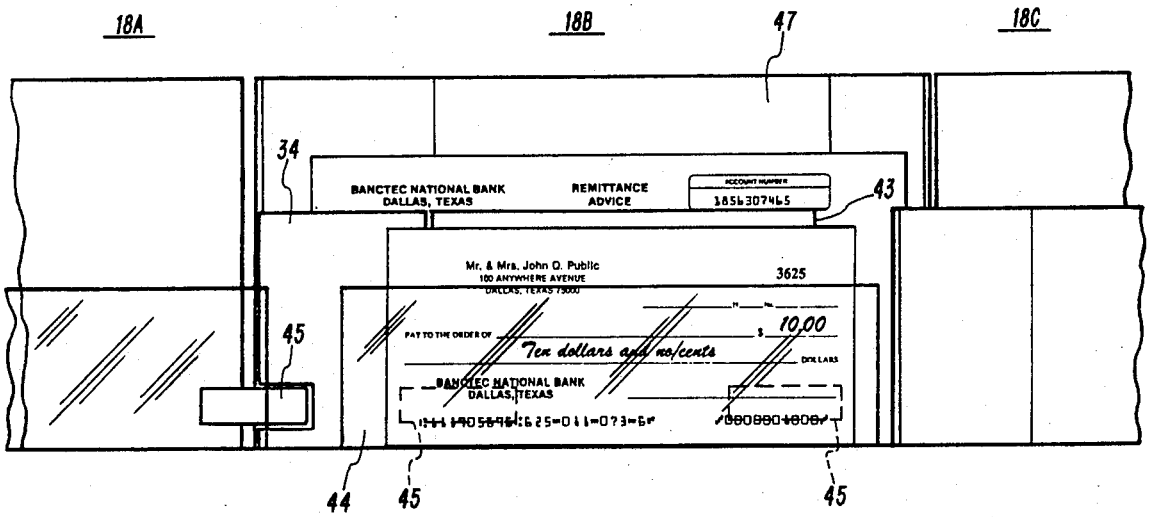
FIG. 4 is an enlarged front view of the primary viewing station depicted in FIG. 1.

As a consequence of the "split path" arrangement at the primary viewing station 18B, documents requiring operator intervention can be routed to the front path 40 directly in front of the operator, with those documents not requiring operator intervention being routed out of the way to the rear path 41. For example, in the remittance processing operation previously described, the remittance document or check 1 requiring encoding of the dollar amount within the field 4 (FIG. 6) will be routed to the front path 40; and a following remittance advice document or stub 2 properly encoded within the field 5 (FIG. 7) will be routed to the rear path 41 behind the check. This respective positioning is best depicted in FIG. 4, it being understood, as subsequently described, that the check and stub respectively positioned in the front and rear paths of the station 18B are normally not of the same transaction set. Alternatively, whenever the existing printing within the field 5 on the stub 2 is defective, the stub (remittance advice document) will be routed to the front path 40 to enable the operator to intervene and activate the keyboard to key enter the correct data for subsequent processing of the stub data.

In accordance with a feature of the present invention, the selective routing of documents to either the front or rear path is automatically controlled in response to the document information detected by the document reader 27. Specifically, and in accordance with the preferred embodiment, the MICR read head 51 is appropriately positioned to detect encoded data on the face of the remittance documents (thus indicating the presence of a "check"); and, under the supervision of the program controlled computer processor, generates a signal in response to such detection which actuates the solenoid 42 at the appropriate time to thereby pivot the diverter 34 to direct the check into the front path 40 at station 18B. The absence of such signal and/or the sensing by the optical character reader head 50 of non-defective data within the field 5 of the remittance advice document will then correspondingly result in the generation of a signal which, at the appropriate time, actuates the solenoid to pivot the diverter 34 to route such remittance advice document to the rear path 41. The optical character reader head 50 is also positioned to detect defective data within the field 5, in which event the solenoid is actuated to pivot the diverter 37 to direct the defectively encoded stub to the front path 40 at the station 18B.

In accordance with an additional feature of the present invention, a preview station 18A is provided upstream of the primary viewing station 18B; and a document hold station 18C is provided immediately downstream of the primary viewing station, these additional stations thus providing multiple viewing positions for the operator. In addition, and as subsequently described with respect to one sequence of operation, the hold station 18C enables the rerouting of a document that had been positioned in the rear path 41 back into the main transport path 20 in accordance with the original document sequence that existed at the time it entered the station 18B.

The sequential advancement of the respective documents to the preview station 18A, the front and rear paths of the primary viewing station 18B, and the document hold station 18C is determined by the software or computer program of the main computer processor unit. Additionally, the particular program, and therefore the document sequencing, can be varied in accordance with the particular user's requirements. For purposes of illustration, however, the following description represents one order of document sequencing which advantageously employs the hereinbefore-described multi-viewing arrangement, and particularly the "split path" arrangement of the primary viewing station 18B.

In the following description, it is assumed that each "transaction set" comprises a single remittance document (check) and a single remittance advice document (stub). Furthermore, it is assumed that the documents have been precollated in a manner that positions the stub of a particular transaction set ahead of its corresponding check, which are then fed in this sequence at the initial feed stations 15 or 16. Additionally, it is assumed that the program or transport logic is designed to "fill" all of the positions in the preview station 18A, front path of station 18B, and hold station 18C. Accordingly, the following chart summarizes the processing of the respective documents for sequential command stages (A,B,C, etc.) with each document of a particular transaction set being designated by a subscript corresponding to that set. For example, $check_1$ and $stub_1$ correspond to one transaction set; $check_2$ and $stub_2$ correspond to a second transaction set, etc. The table is as follows:

| Command Stage | Preview Station 18A | 18B Rear Path | 18B Front Path | Hold Station 18C | Encode Station 21 |
|---|---|---|---|---|---|
| A | $check_1$ | | $stub_1$ | | |
| B | $stub_2$ | | $check_1$ | $stub_1$ | |
| C | $check_2$ | $stub_2$ | $check_1$ | $stub_1$ | |
| D | $stub_3$ | | $check_2$ | $stub_2$ | $check_1$ |
| E | $check_3$ | $stub_3$ | $check_2$ | $stub_2$ | |

-continued

| Command Stage | Preview Station 18A | 18B Rear Path | 18B Front Path | Hold Station 18C | Encode Station 21 |
|---|---|---|---|---|---|
| F | $stub_4$ | | $check_3$ | $stub_3$ | $check_2$ |

Accordingly, and as summarized by the above table, at the end of initial command stage A, the $stub_1$ will be advanced to the front path of station 18B, while its following $check_1$ is advanced to preview station 18A. In this instance, even though $stub_1$ does not have defective coding, it is positioned in the front path of 18B for the purpose of filling all stations. Documents are then advanced through command stages B and C until, at the end of command stage C, all positions are filled; the $check_1$ thus being presented in the front path of station 18B for operator intervention, and $stub_1$ being in the hold station 18C. At the same time, the properly encoded $stub_2$ has advanced to the rear path of the station 18B. At the end of the next command stage (D), the $check_2$ is advanced to the front path of station 18B, with $stub_2$ advanced to the hold station 18C; and $check_1$ has advanced to the encoding station 21 for encoding of the dollar amount. This similar sequence for the other checks and stubs will occur during command stages E and F.

It is thus observed that after the initial filling of all stations, all checks requiring operator encoding will be positioned in the front path of station 18B, all stubs not requiring operator intervention will be positioned in the rear path of station 18B; and the hold station 18C enables each stub to be repositioned ahead of the corresponding check, i.e. in the same sequence when the documents entered the station 18B. The preview station 18A, being located immediately adjacent the primary viewing station 18B, thus assists in enhancing the overall speed of the document processing since it positions the next document ready for entry into the station 18B, upon command. This is in addition to providing a multiple view (or preview) station for the operator.

It is thus observed that the arrangement of the document presentation station 18, particularly the split path primary viewing station thereof, enables the convenient and rapid processing of the documents through such station. While such arrangement has particular advantage in a remittance processor, it is to be understood that such arrangement, and particularly the split path transport, will be useful for the processing of various type of documents where only selective ones of those documents require operator intervention.

For example, in accordance with an alternative embodiment, a document processor can incorporate a primary viewing station (like 18B) having the previously described split path arrangement. Documents requiring operator intervention can then be diverted, as previously described, to front path 40, while documents not requiring operator intervention can be continuously transported to and through station 18B by way of rear path 41 and back into the main transport passageway. In this manner, the overall throughput is increased with documents not requiring operator intervention continuing to be transported through the document processor while the operator performs the necessary operation with respect to the document halted in the front path 40.

It is also to be understood that while the previous description has made reference to an operator positioned directly in front of the viewing station, it may be desired to utilize a camera focused at the documents at the viewing station in order to capture an image of such documents.

Various modifications to the disclosed embodiments, as well as alternate embodiments of the invention, may be become apparent to a person skilled in the art without departing from the spirit and scope of the invention as defined by the appended claims.

What is claimed is:

1. Apparatus for processing remittance and remittance advice documents, comprising:

(a) reader means disposed at a reading station for reading information disposed on the front face of said remittance and remittance advice documents, said reader means including discriminating means responsive to the so-read information for determining which of said documents are first type remittance documents requiring operator intervention and which of said documents are second type remittance advice documents not requiring operator intervention;

(b) encoder means disposed at an encoding station for encoding data on selected ones of said documents;

(c) an operator viewing station disposed between said reader means and said encoder means;

(d) document transport means for transporting said documents past said reader means to said operator viewing station, for halting both said first and second type documents at said operator viewing station, and for thereafter transporting said documents from said viewing station to said encoding station;

(e) means disposed at said operator viewing station defining respective front and rear parallel transport paths; and (f) diverter means responsive to said discriminating means for always directing said first type remittance documents entering said operator viewing station and requiring operator intervention to said front transport path, and for always directing said second type remittance advice documents entering said operator viewing station and not requiring operator intervention, as determined by the said information read by said reader means, to said rear transport path.

2. The apparatus as defined by claim 1 further comprising:

keyboard means for operator entry of data corresponding to new information to be printed on the front face of said first type of documents.

3. The apparatus as defined by claim 1 further comprising:

a document hold station downstream from said operator viewing station and means for advancing a document from the rear transport path to, and for halting at, said document hold station.

* * * * *